US006572091B2

(12) United States Patent
Kimble

(10) Patent No.: US 6,572,091 B2
(45) Date of Patent: Jun. 3, 2003

(54) MAGNETIC LOCKING VACUUM CHUCK SYSTEM

(76) Inventor: Alvin Kimble, 13035 SE. Claybourne, Portland, OR (US) 97236

( * ) Notice: Subject to any disclaimer, the term of this patent is extended or adjusted under 35 U.S.C. 154(b) by 0 days.

(21) Appl. No.: 10/081,759

(22) Filed: Feb. 20, 2002

(65) Prior Publication Data

US 2002/0140149 A1 Oct. 3, 2002

Related U.S. Application Data

(60) Provisional application No. 60/270,445, filed on Feb. 20, 2001.

(51) Int. Cl.[7] ..... B25B 11/00

(52) U.S. Cl. ..... 269/21; 269/20; 269/309

(58) Field of Search ..... 269/21, 20, 309; 294/64.1; 451/388

(56) References Cited

U.S. PATENT DOCUMENTS 5,365,030 A * 11/1994 Hayakawa ..... 269/21
5,837,901 A * 11/1998 Sola et al. ..... 269/21
6,182,955 B1 * 2/2001 Kimble ..... 269/21
6,264,185 B1 * 7/2001 Isobe et al. ..... 269/21

* cited by examiner

*Primary Examiner*—Lee Wilson
(74) *Attorney, Agent, or Firm*—Marger Johnson & McCollom, PC

(57) ABSTRACT

An apparatus for chucking a workpiece to a worktable includes a plurality of magnetically activated vacuum flow check valves, which uses a magnet within its body, to block a port through which atmosphere can flow to a vacuum source. The magnet blocking the flow can be drawn off the port seat by positioning a second (activator) magnet in a cavity of the valve body proximal the first magnet. The resulting effect is the communication of a vacuum suction force from the vacuum source to the workpiece. The second (activator) magnet is preferably affixed to a bottom surface of a puck which, when received within a complementary structure on the valve assembly, serves as a chucking mechanism for securely holding a workpiece above the surface of the machining table during the machining operating.

7 Claims, 4 Drawing Sheets

14
9b
13
12
11
10
9a 21
6
7
17
8
11
12
1
15
20
Vacuum source

ATMOSPHERE
VACUUM SOURCE
VACUUM SOURCE
8
17
9b
9a
10
12
14
15
20
7
17
12
14
20

MAGNETIC LOCKING VACUUM CHUCK SYSTEM

CROSS-REFERENCES TO RELATED APPLICATIONS

This application claims the benefit from U.S. Provisional Patent Application No. 60/270,445 filed Feb. 20, 2001 whose contents are incorporated herein for all purposes.

BACKGROUND OF THE INVENTION

1. Field of the Invention

This invention relates to providing a quick setup method for holding via vacuum materials to be machined on CNC routers or similar equipment.

2. Description of the Prior Art

Typically all CNC routers or similar equipment are equipped with a vacuum source. The vacuum generated by this source is the means used to hold a workpiece via different apparatuses during the machining operation.

There are generally two methods of setting up of a router bed so that the bed holds workpieces in the proper position for machining. The oldest and most common is manually. Another more recent method is to use programmable elevated/retracted pods that are vertically positioned via computer commands. The manual method, while less expensive, typically requires a complicated and time-intensive setup procedure over the automated one.

Accordingly, the need remains for an improved manual method for setting up a router bed.

SUMMARY OF THE INVENTION

The current invention reduces the time required to position mounting jigs (pucks) that hold a workpiece during machining. The, system taught herein is composed of an airtight sheet of material (phenolic or like products) placed on top of the machining bed of the CNC router. An array of evenly spaced cavities are machined into the surface of this material and a magnetically-based valve constructed according to the present invention is placed into each cavity. Once all the machined cavities are filled with the magnetically based valve, the table surface is airtight so as not to allow any atmosphere to be drawn through the table when the vacuum pump is turned on.

The operating principal behind the valve is based on the natural attraction of magnets to one another. A magnet ("valve magnet") is placed in the valve on a rubber seat so as to block a port in the bottom of the valve when vacuum is turned on. When an operator wants to have a valve opened he/she places a fixture or "puck" that contains an attracting magnet ("activator magnet") over the valve body. The valve magnet fit into a cavity in the top of the valve body and the attracting force of the activator magnet pulls the magnet contained in the valve off of the rubber seat. When the valve magnet is pulled from the seat, atmosphere is allowed to flow through the valve body.

Preferably, these fixtures are made with gaskets or O-rings positioned around their parameter. The gaskets create a vacuum barrier when a workpiece is placed onto the fixture. Once the workpiece is placed onto the fixture, it in effect creates a seal that stops the flow of atmosphere through it and thus achieves a vacuum chucking effect that holds the workpiece to the fixture. The force of the vacuum chucking pressure further prevents the workpiece from moving during the machining operation.

Two unique advantages are achieved using this system. First the activator magnet on the base of the material holding fixture (puck) opens the valve when the activator magnet is positioned into the cavity of the magnetically based valve configured according to the present invention. This eliminates the need to pull plugs, drill holes into a fixture board or fit gasketing into grooves machined into the table that act as vacuum dams. The second unique advantage is that the activator magnet also act as position locators. By placing numbers consecutively into the bottom of each cavity the operator can receive a pre-machining set-up sheet that tells the operator which valves to cover with the pucks. This eliminates the need to reference the fixture or the workpiece from a known position.

In short, the valves of the present invention create an airtight vacuum bed except in those locations in which pucks having activator magnet are received. This results in the activator magnet attracting the valve magnet, and pulling it from the seat to allow atmosphere to flow through the valve body. Fixturing is used to hold the workpiece above the base level of the table and thereby preventing routing tools from easily passing through the workpiece and impacting upon the surface of the table. By allowing vacuum to pass through the puck fixtures, a seal is formed where the workpiece is placed onto the fixtures and the workpiece is held securely in one position during the machining operation. It should also be understood that when the activator magnet is removed from a valve cavity, the magnet in the valve falls over the vacuum port in the bottom of the valve and thereby blocking atmosphere from passing through the valve.

Besides part holding fixtures, there can be a myriad of other fixtures that may contain clamps, rollers, slides, sensors, etc. The one thing any fixture must have in common is that it contain one or more activator magnets.

Finally, the magnetically-based valve can be used in many applications such as Down-draft tables to hold a workpiece still while being hand sanded, or they can be used in a frame clamping table for positioning and holding the pneumatic clamps secure. Characteristics relating to the embodiments disclosed herein are not to be considered as limiting, unless the claims expressly state otherwise.

DETAILED DESCRIPTION OF THE PREFERRED EMBODIMENT

For the propose of description the orientation of the table is assumed to be on a horizontal CNC router bed, but it must be understood that the orientation can change with the needs of the application or equipment it is placed. It is also understood that the specific devices and processes are simply exemplary embodiments of the inventive concepts defined in the claims. Hence specific dimensions and other physical characteristics relating to the embodiments disclosed herein are not to be considered as limiting, unless the claims expressly state otherwise.

Figure 1:
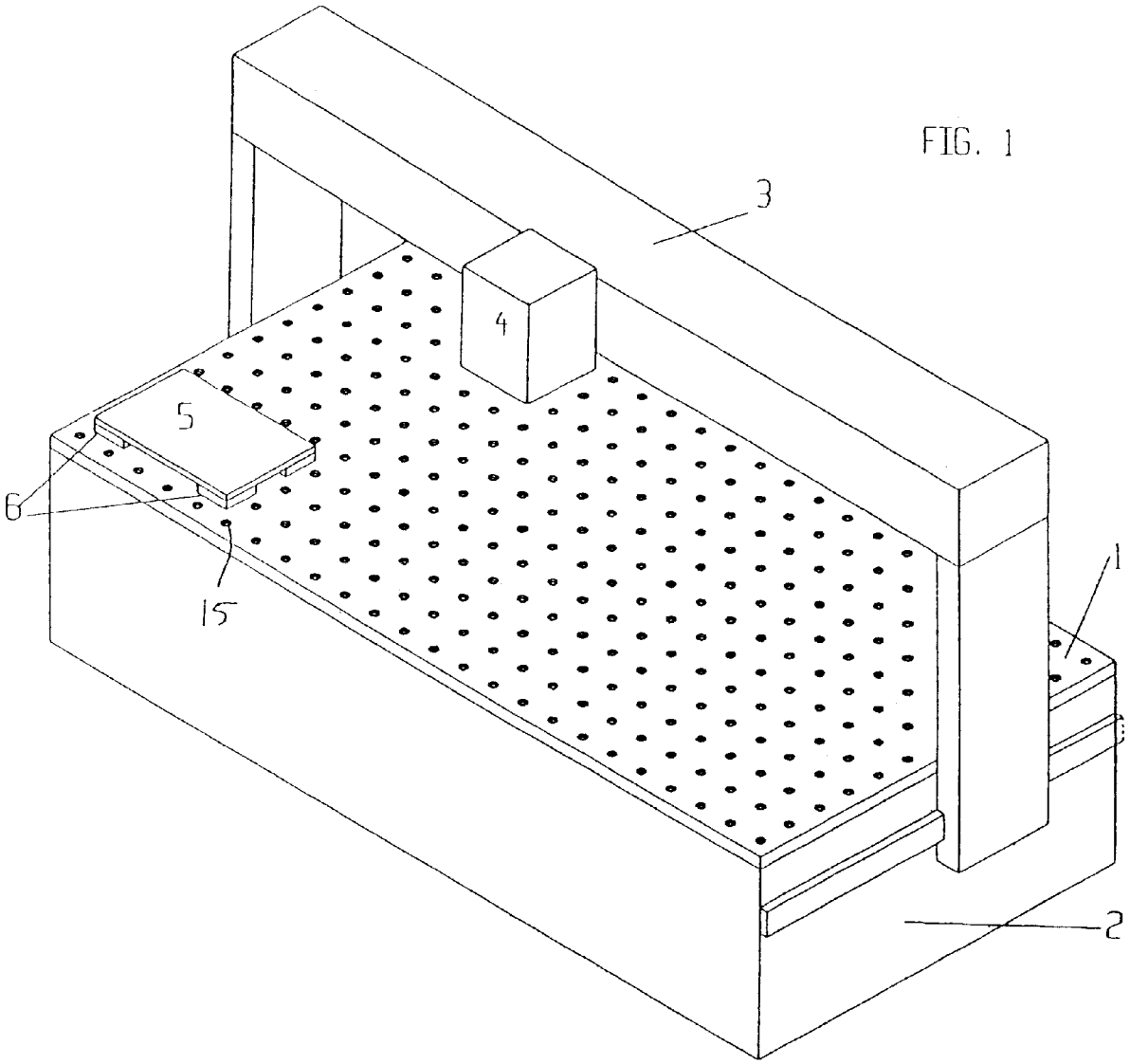
FIG. 1 is a schematic drawing of a CNC router.

FIG. 1 is a schematic view of the inventive system placed on a conventional CNC router. The router components 4 moves back and fourth across the beam or gantry 3 on which router components 4 are mounted. The beam 3 itself is coupled to the router table frame 2 so that it too can move forward and backwards to allow accurate X-Y axis positioning of the router components 4 above the table surface. A vacuum bed 1, shown with the array of circles and constructed according to the present invention as described below, is placed onto the surface of the router table 2. A workpiece 5 is shown placed in the lower left corner of the bed 1 and is held above the bed via material holding fixtures 6, also called pucks.

The reference to element 1 in all drawings generally designate the surface substrate into which the valve assembly, constructed according to the present invention, is placed. The surface substrate, referred to as the top, may be composed of numerous materials known to those skilled in the art and is usually placed on a CNC router table 2 or similar piece of equipment but may also be a stand-alone tabletop used simply for vacuum chucking of a workpiece while hand work is being performed. The top 1 is machined to have an array of specifically configured holes 15 across the surface. Into these holes the valve body assembly 8 (FIG. 2) of the present invention is placed. Once the holes 15 have been filled with the valve assemblies 8, the top can be coupled to a vacuum source, whether that be laid on top a CNC router table 2 such as shown in FIG. 1, or any other equipment having a vacuum source and that would use this invention.

Once the completed valve surface of the present invention has been placed onto a vacuum source it provides an airtight vacuum bed. That is to say that air from the atmosphere around the table cannot pass through the top to the vacuum source. When an operator (person using the equipment) wants to hold a workpiece (illustrated by element 5 in FIGS. 1 and 2) for machining purposes, he/she places a puck (element 6 in FIGS. 1,2,3) with one or more activator magnets 7 so that the activator magnets fit into a cavity 17 of the valve assembly 8. The activator magnet 7 serves two purposes: the first is to draw the valve magnet 12 of the assembly 8 off of the rubber valve seat 11 and thereby allow atmosphere to flow through the valve to the vacuum source; the second purpose of the activator magnet 7 is positioning of the puck within a cavity 15 having an assembly 8 received therein. Positioning can be better understood by explaining that each valve assembly 8 has placed in the bottom of its cavity 17 a visually perceivable number that consecutively increases with each valve across the array on the top. This then allows the operator to be able to identify an assembly by either a printout of the top or by a list of numbered valve assemblies. A programmer may then create a set of instructions telling the operator where to place a puck or group of pucks 6 by describing the number, position and orientation of the puck to the top. This process affords an extremely efficient method for preprinting a top to receive the workpiece.

Figure 2:
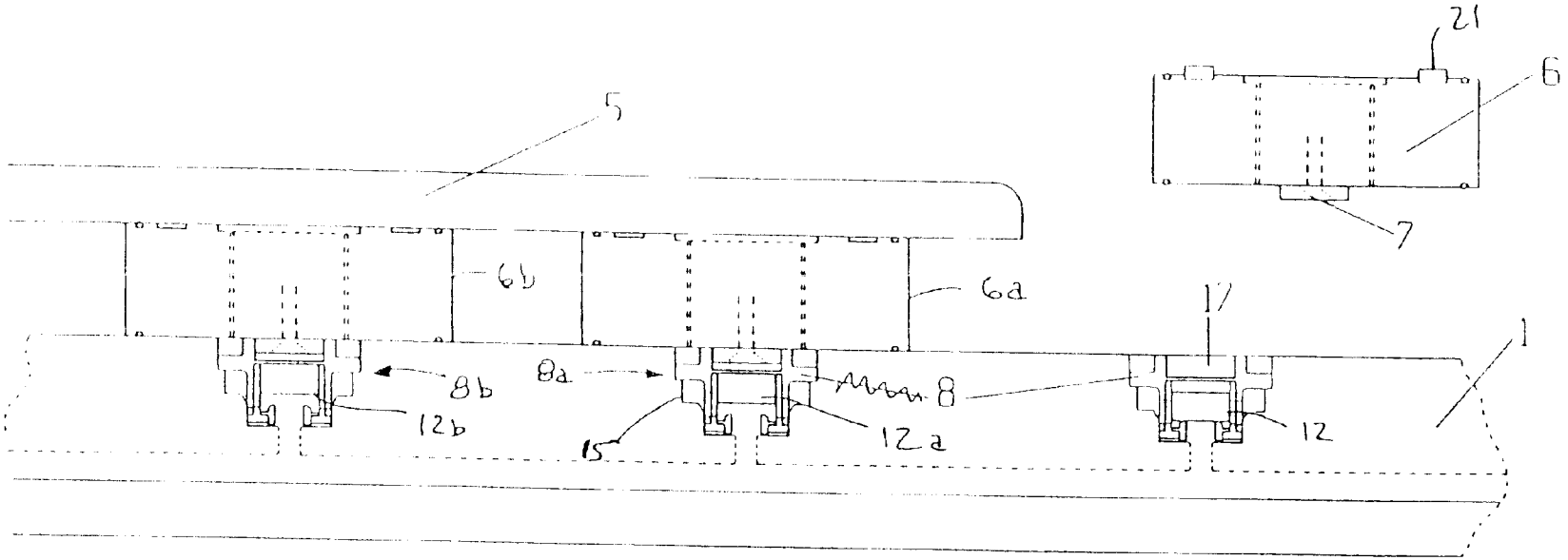
FIG. 2 shows a cross section, side elevation of the vacuum chucking table with three valves, constructed according to a preferred embodiment of the present invention, installed.

FIG. 2 shows a cross section, side elevation of the vacuum chucking table 1 with three valves assemblies 8, constructed according to a preferred embodiment of the present invention, installed within respective table top cavities 15. Two of the valve assemblies 8*a,* 8*b* are covered with puck 6*a,* 6*b* on which a workpiece 5 has been placed. It can be seen that the magnets 12*a,* 12*b* in the valves 8*a,* 8*b* are pulled off of the seat, thus allowing a vacuum lock to be formed between the puck 6 and the workpiece 5. A third puck 6 is shown elevated above the surface of table 1 with activator magnet 7 adapted to be received within cavity 17 formed in top of the associated valve assembly 8. Note that the magnet 12 in that valve assembly 8 is blocking the seat, stopping the flow of atmosphere through the valve.

Figures 3A, 3B:
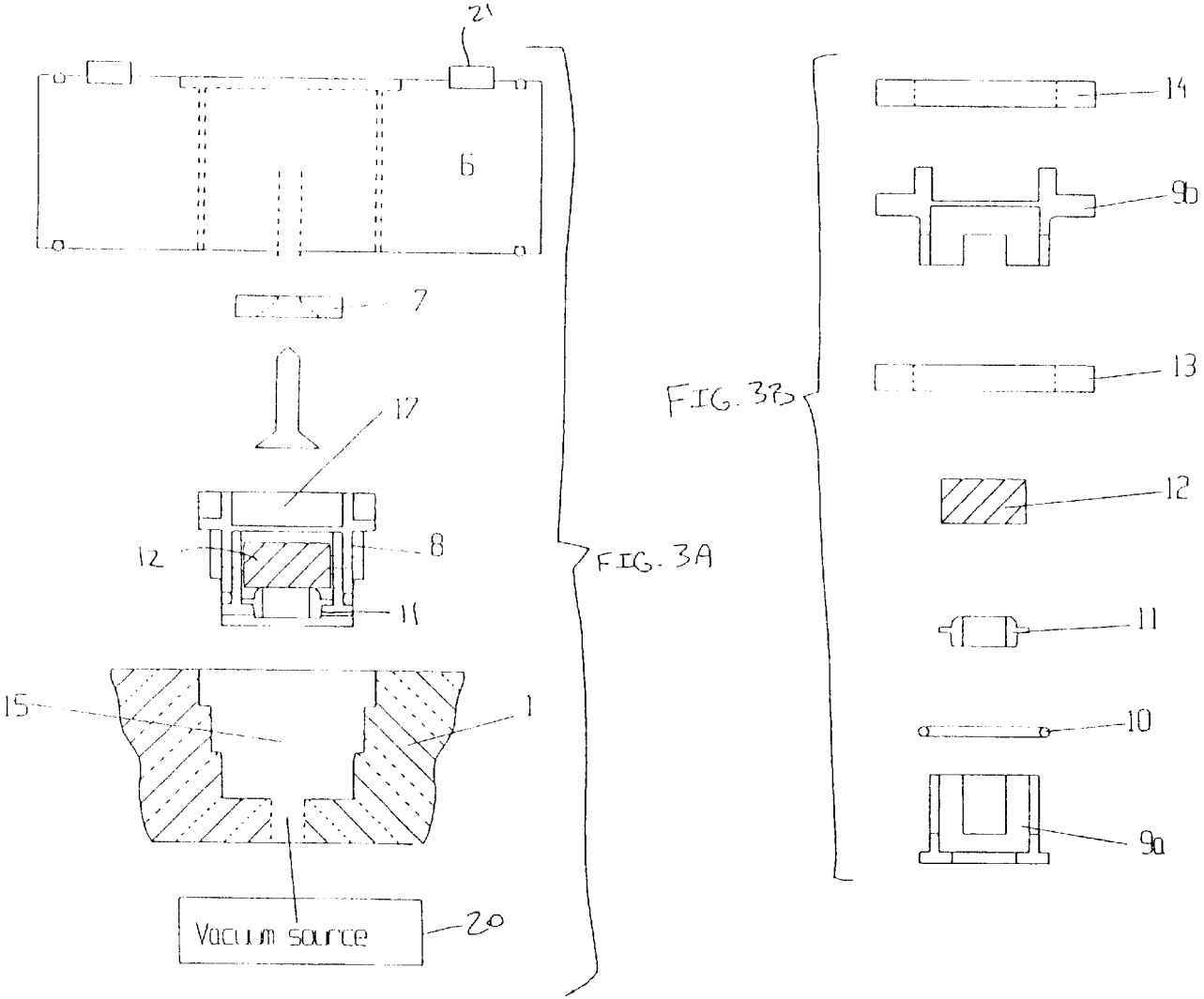
FIGS. 3A and 3B show the components of the table valve system of FIG. 2 in side-elevation exploded view, including a puck with activator magnet constructed according to a preferred embodiment of the invention.

Regarding the working concept of the magnetically-based valves implemented according to the present invention, the following is a description of the function of the puck assembly with reference to FIG. 3B. The valve body housing pieces 9*a,* 9*b* are injection molded plastic parts that are glued as they slice together. The assembly requires that the valve seat 11 be placed into a hole in the bottom of housing 9*a;* the o-ring 10 placed over the outside of the bottom of housing 9*a;* and the valve magnet 12 set on top of the seat 11. The top of the valve housing is then glued and slid over the bottom housing 9*a* so as to complete the assembly 8. Finally the two dust filters 13, 14 are slid onto the resulting assembly 8 (see, e.g., FIG. 3A).

FIG. 3A illustrates in side-elevation cross-section the placement of the magnetic valve assembly 8 into the cavities 15 formed in an array on vacuum bed 1. The valve magnet 12 is shown captured within a cavity formed by coupling the lower housing 9*a* of the magnetic valve with the upper housing 9*b,* where the cavity has a height that is larger than the height of the magnet so that the valve magnet 12 can be moved away from the valve seat 11 and thus allow a vacuum from vacuum source 20 to move up through the valve assembly 8 when the assembly 8 is placed within router bed cavity 15. An activator magnet 7 is affixed to the underside of puck 6 which centers the puck 6 within the top cavity 17 of the valve assembly housing and draws the valve magnet 12 upward away from the valve seat 11. When so activated, vacuum pressure is communicated from vacuum source 20 to the top side of puck and thence to the workpiece 5 to forcibly hold it to the top of the puck as shown in FIG. 2. A foam gasket 21 encircles the puck topside to help prevent vacuum leakage.

Figures 4A, 4B:
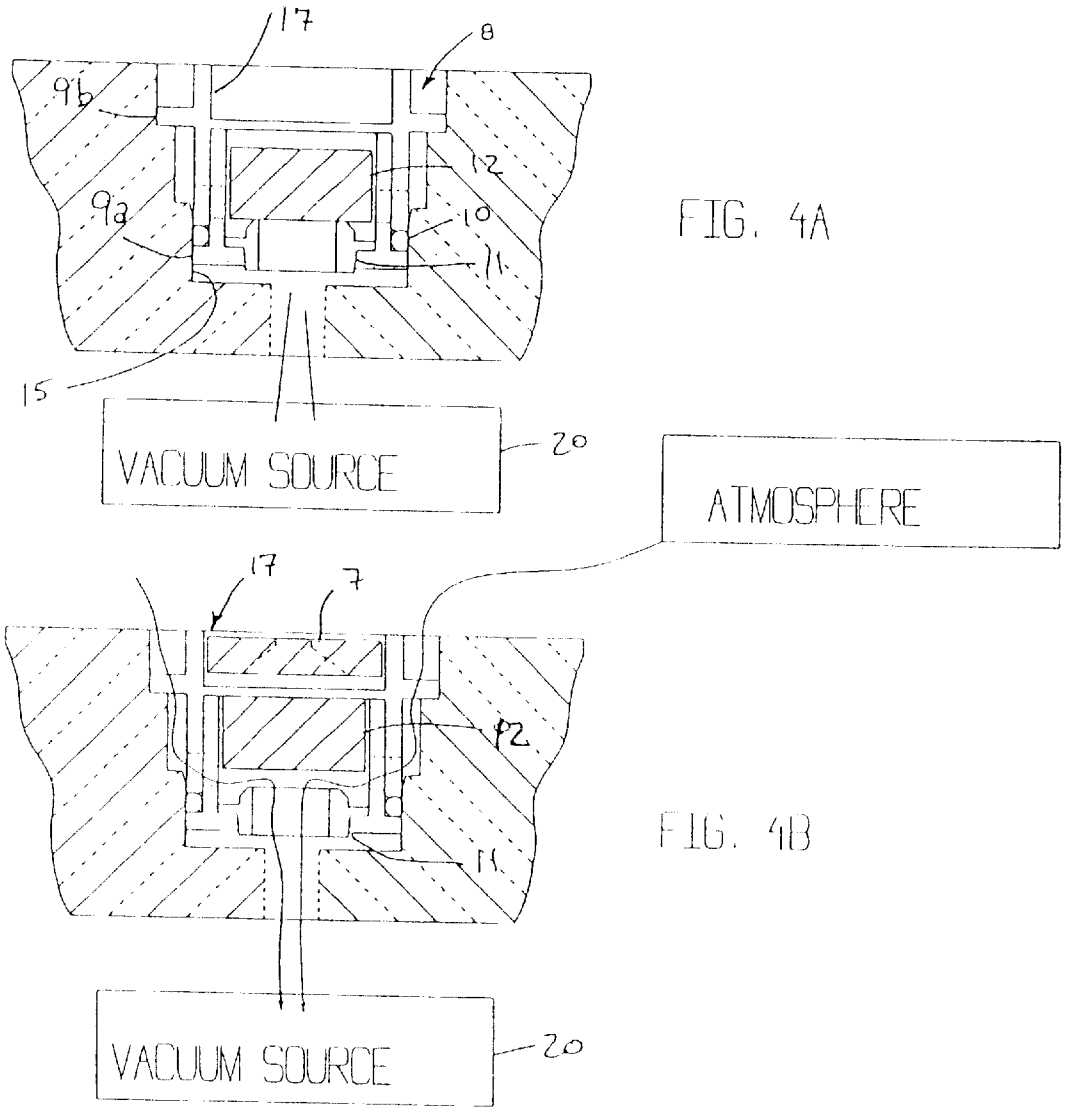
FIGS. 4A and 4B illustrate side elevation cross sections of the valve body in an inactivated and activate state, respectively.

FIGS. 4A and 4B illustrate side elevation cross sections of the valve body in an inactivated (with no activator magnet present) and in an activate state (with activator magnet 7 received with the valve assembly cavity 17 and proximal the valve magnet 12), respectively.

FIG. 4A is a cross sectional of a valve assembly 8 placed into a cavity. It shows the valve magnet 12 in its natural position, which is blocking flow of atmosphere through the valve to the vacuum source 20. When as illustrated in FIG. 4B the activator magnet 7 is placed into the cavity 17 molded into the top of valve assembly housing 9*b,* the valve magnet 12 is drawn up off of the seat 11 thus allowing atmosphere to pass from atmosphere to the vacuum source. At this point of time the vacuum source is not energized so that there is no flow of pressure from atmosphere to the vacuum source.

Having described and illustrated the principles of the invention in a preferred embodiment thereof, it should be apparent that the invention can be modified in arrangement and detail without departing from such principles. I claim all modifications and variation coming within the spirit and scope of the following claims.

What is claimed is:

1. A chucking apparatus adapted to be placed between a vacuum source and a workpiece comprising:

a housing having a vacuum inflow aperture and a vacuum outflow aperture, said housing further including a cavity in communication with the vacuum inflow aperture; and a valve magnet received within the cavity and magnetically moveable between an inactive position against the vacuum inflow aperture and an active position in which the vacuum from the vacuum source is communicated through the vacuum inflow aperture and the vacuum outflow aperture.

2. The chucking apparatus of claim 1, further including:

a puck having a top side and a bottom side, including means for communicating vacuum from the bottom side to the top side; and an activator magnet affixed to the bottom side of the puck and adapted to be received within the housing to activate the valve magnet and thereby communicate vacuum pressure from the vacuum source to the top side of the puck for chucking a workpiece laid thereon.

3. The chucking apparatus of claim 2, wherein the activator magnet is affixed to a central portion of the puck bottom side.

4. A chucking apparatus comprising:

a vacuum source;

a table top including an array of holes in communication with the vacuum source;

a valve apparatus received within each of the holes, each of the valve apparatuses having a valve magnet received within a cavity, said valve magnet having an inactive position in which vacuum is not communicated through the valve apparatus, and an active position in which vacuum is communicated through the valve apparatus; and a puck engaged with at least one of the valve assemblies, said puck including an activator magnet positioned proximal to the engaged valve assembly so that the valve magnet is placed in the active position.

5. The apparatus of claim 4, wherein said puck includes a top surface that is raised above a top surface of the table so that a workpiece laid on top of the puck is supported above the top surface of the table.

6. A method for chucking a workpiece on a vacuum table having a vacuum source comprising:

interposing a plurality of valve assemblies between the vacuum source and the workpiece; and magnetically activating a selected number of valve assemblies to conduct a vacuum pressure through the valves to the workpiece, wherein the step of magnetically activating the valve assemblies includes:

blocking a vacuum inflow aperture using a first magnet; and positioning a second magnet proximal the first magnet to thereby move the first magnet from a blocking position.

7. The method of claim 6, further including affixing the second magnet to a bottom surface of a puck and placing the bottom surface of the puck adjacent one of the valve assemblies so that the puck is interposed between the valve assembly and the workpiece.

* * * * *